US006513170B1

(12) United States Patent
Chiang

(10) Patent No.: US 6,513,170 B1
(45) Date of Patent: Feb. 4, 2003

(54) PAIR OF SWIMMING GOGGLES

(76) Inventor: Herman Chiang, 11F-2 No 634-9 Ching-Ping Rd., Chung-Ho City Taipei Hsien (TW)

( * ) Notice: Subject to any disclaimer, the term of this patent is extended or adjusted under 35 U.S.C. 154(b) by 0 days.

(21) Appl. No.: 09/969,044

(22) Filed: Oct. 1, 2001

(51) Int. Cl.[7] ..... A61F 9/02
(52) U.S. Cl. ..... 2/428; 2/445; 2/452
(58) Field of Search ..... 2/428, 430, 445, 2/452, 446, 426

(56) References Cited

U.S. PATENT DOCUMENTS 1,369,040 A * 2/1921 Malcom ..... 2/445
4,162,542 A * 7/1979 Frank ..... 2/430 X
5,303,428 A * 4/1994 Pernicka ..... 2/452
5,706,527 A * 1/1998 Kita ..... 2/452
6,112,334 A * 9/2000 Chiang ..... 2/428
6,145,133 A * 11/2000 Sato et al. ..... 2/428

* cited by examiner

*Primary Examiner*—Peter Nerbun
(74) *Attorney, Agent, or Firm*—Troxell Law Office PLLC

(57) ABSTRACT

A pair of swimming goggles includes two lens frames, each of which receives a lens unit and has a chamfer disposed on the side thereof, a nose bridge joining the two lens frames including a body with a staff on each end thereof, a stopper being located on the edge of the staff, a strap means comprising a strap element with a first and a second free end and a fastener having a first jacket assembly and a second jacket assembly mounted respectively on the first and second free end of the strap element whereby the first and second jacket assembly are connectable, such structures as the nose bridge and two lens frames can be conveniently assembled when the user replaces or adjusts the nose bridge.

4 Claims, 9 Drawing Sheets

PAIR OF SWIMMING GOGGLES

FIELD OF THE INVENTION

The present invention relates to a pair of swimming goggles, in particular, a pair of swimming goggles which can be conveniently assembled and held fixedly through a nose bridge connection to lens frames.

BACKGROUND OF THE INVENTION

The constitution of conventional swimming goggles is show in FIG. 1, a nose bridge 50 of the swimming goggles 5 is strip 51 which has several ribs 510 which are respectively disposed on both ends of strip 51 that can be respectively passed through and secured to a joining slot 520 of each lens frame 52 during assembly. Thus the user will be able to adjust the distance between two lens frames to conform with the ridge of the user's nose, with adjustment of position made by squeezing the ribs 510 into slots 520 on the nose bridge, so as to resist the water seepage and get fitting contact with the user's face. Since the ribs 510 are saw-tooth shape and offer the function of a stop, thereby resulting in the strip 51 being hard to pull and move its position during adjustment, especially, to adjust a big distance between two lens frames. The user must use larger force to pull for moving and squeezing the ribs 510 into the slots 520, thereby the ribs 510 will become flattened and the function of adjustment will fail, whereby the ribs 510 would not securely connect two lens frames and facilitate disconnection together when wearing the swimming goggles on the user's head, or would be lead to water seepage when in use.

OBJECTS OF THE INVENTION

The object of the present invention is to provide a pair of swimming goggles which can conveniently and securely assemble a nose bridge into lens frames.

The other object of the present invention is to provide a pair of swimming goggles which reduce the nose bridge damage during adjustment and offer long live in use.

To achieve the above objects, a pair of swimming goggles of the present invention is featured in that: the nose bridge has a body with a staff that is disposed on each end of the body. Two lens frames are provided, each of which has a chamfer extending from the inner side of a major axis of the lens frames and which could be engaged to the staff, and a pit is transversely disposed on and at an end of the chamfer.

According to the above features of the present invention, the staff has a neck portion which is formed on the edge of the body, and a rounded body extends from the neck. An enlarged end is formed on an end of the rounded body. The chamfer has a hollow with an open end at an inner portion of the chamfer, a stopper on an upper portion of the open end and an inner dimension of the hollow is smaller than an inner dimension of the enlarged end of the rounded body, such that the enlarged end of the rounded body will be able to engage with the stopper of the hollow.

BRIEF DESCRIPTION OF THE DRAWINGS

Other features and advantages of the present invention will become apparent in the following detailed description of the preferred embodiments with reference to the accompanying drawings of which.

DETAILED DESCRIPTION OF THE PREFERRED EMBODIMENT

Figure 1:
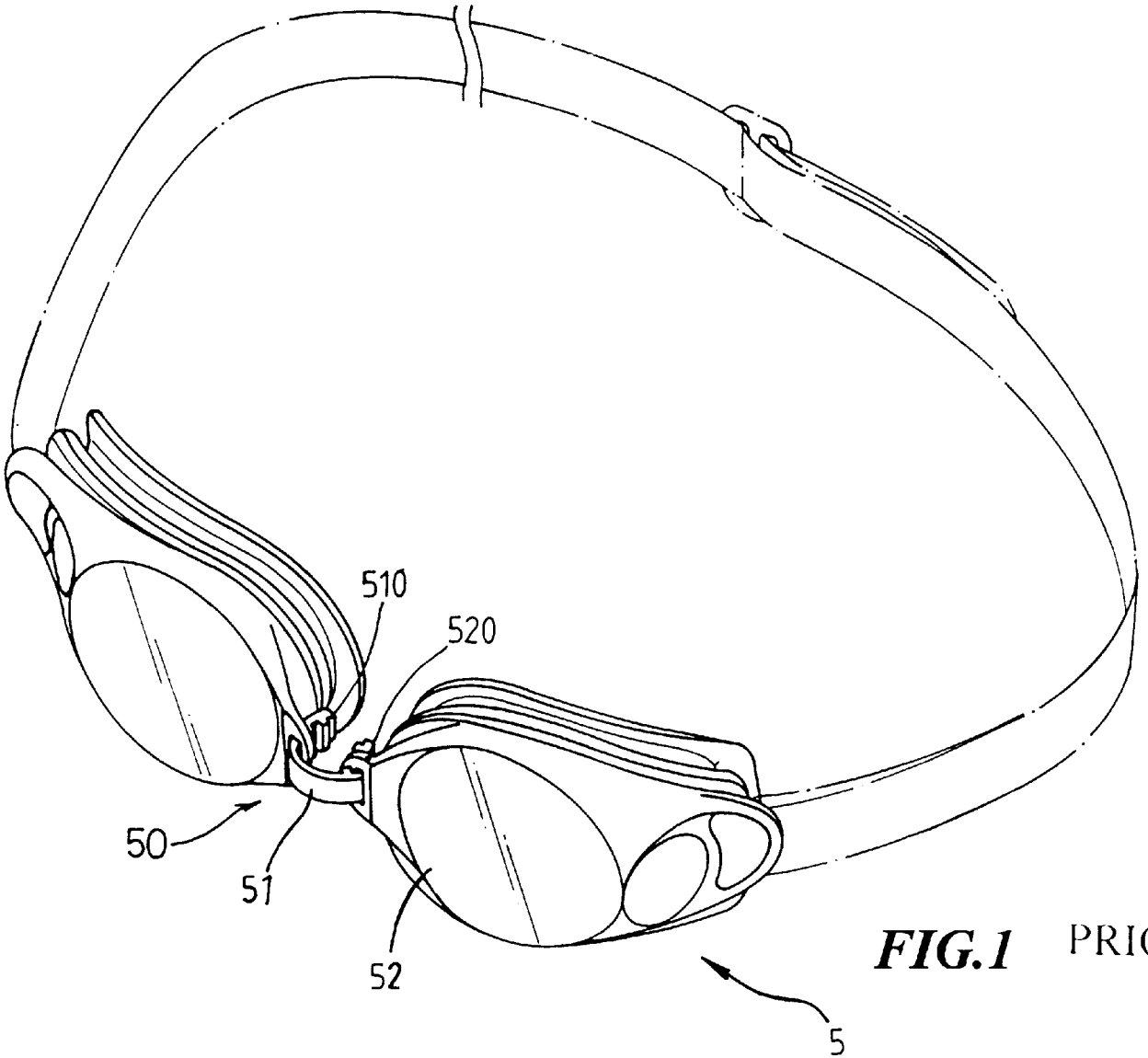
FIG.1 PRIOR ART
FIG. 1 is a perspective view of prior art swimming goggles.
Figure 2:
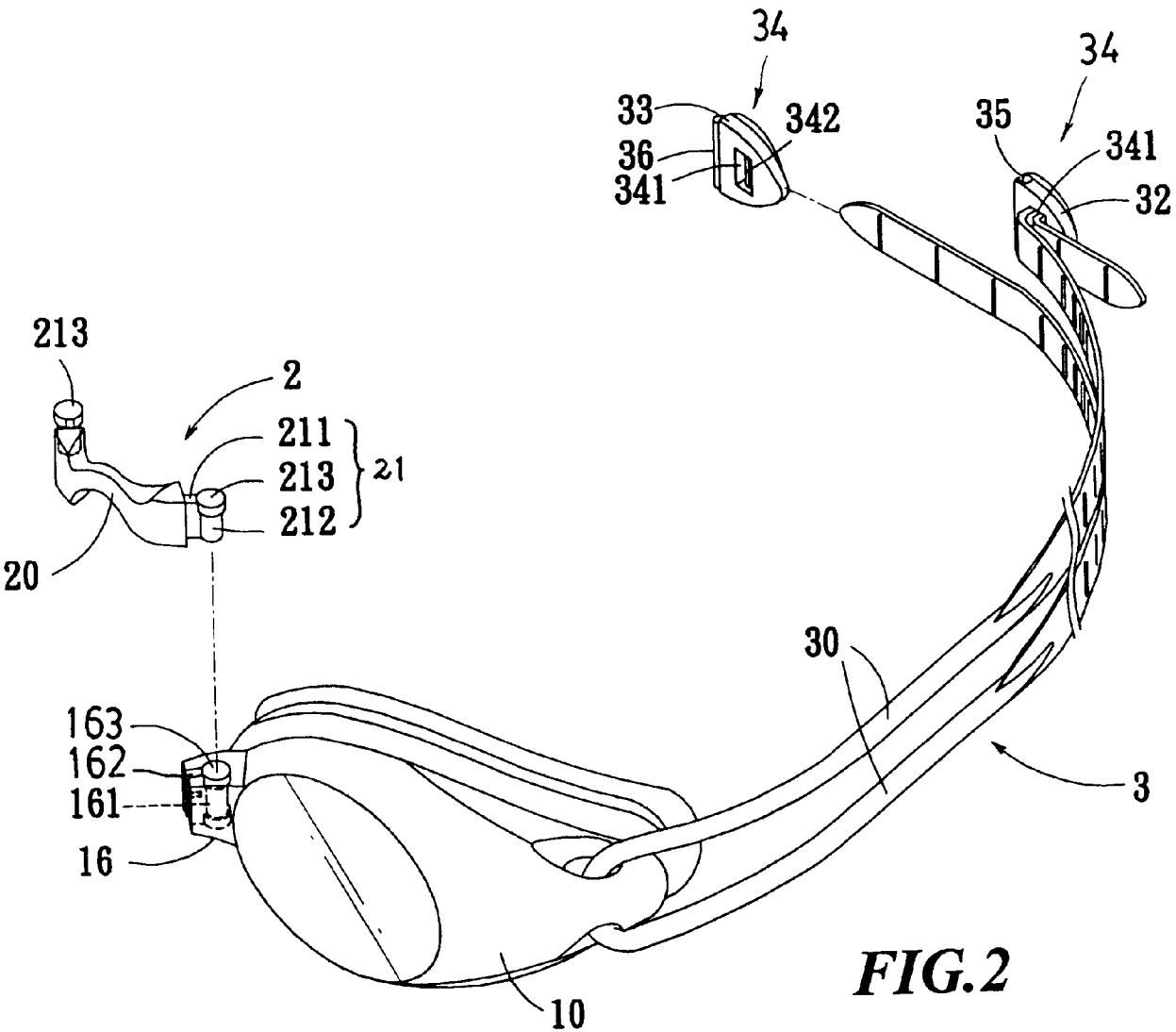
FIG. 2 is a perspective view which illustrates disassembly of the single lens frame of the present invention.
Figure 3:
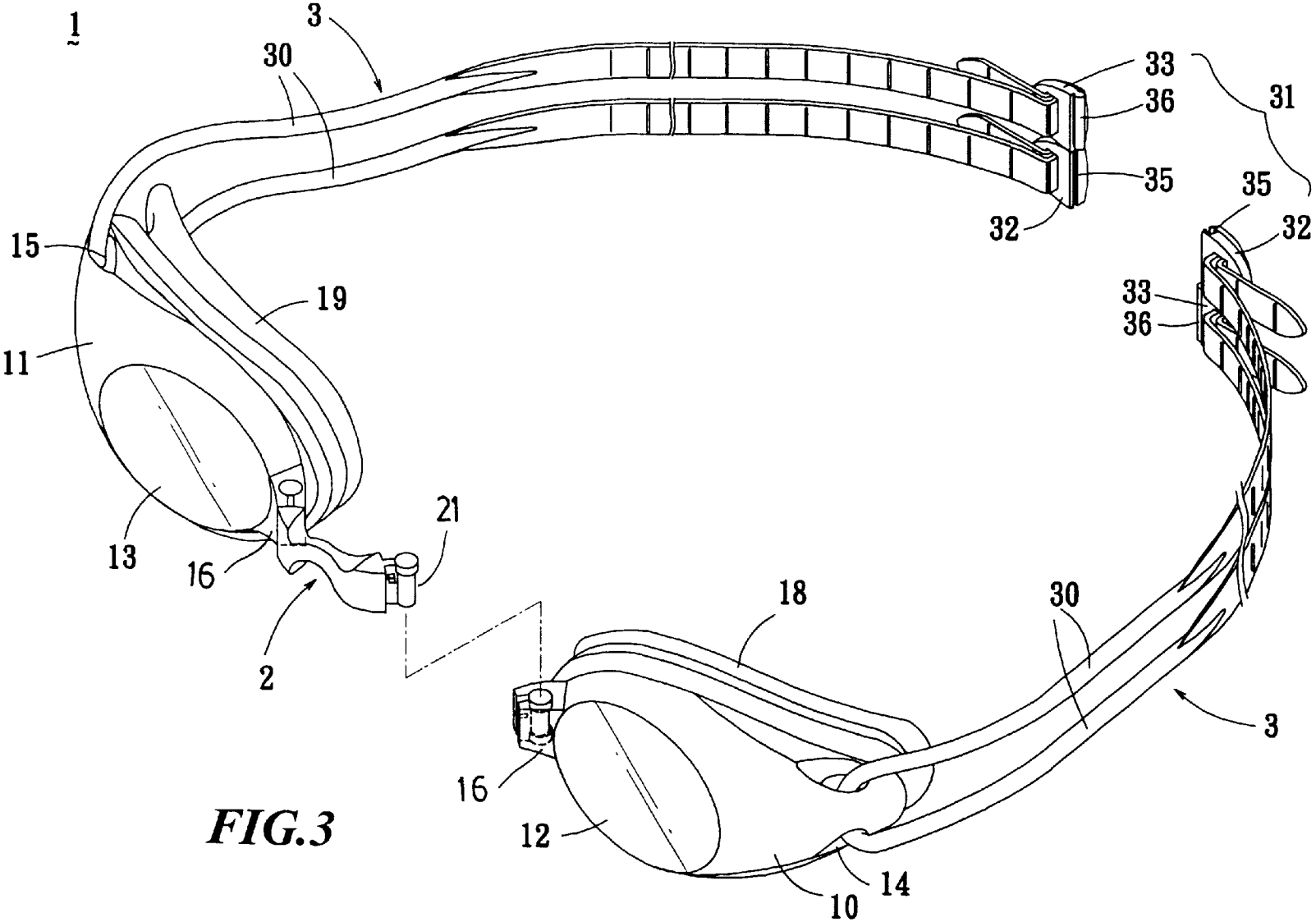
FIGS. 3 and 4 are perspective views which illustrate disassembly and assembly of dual single lens frames and the nose bridge of the present invention.
Figure 4:
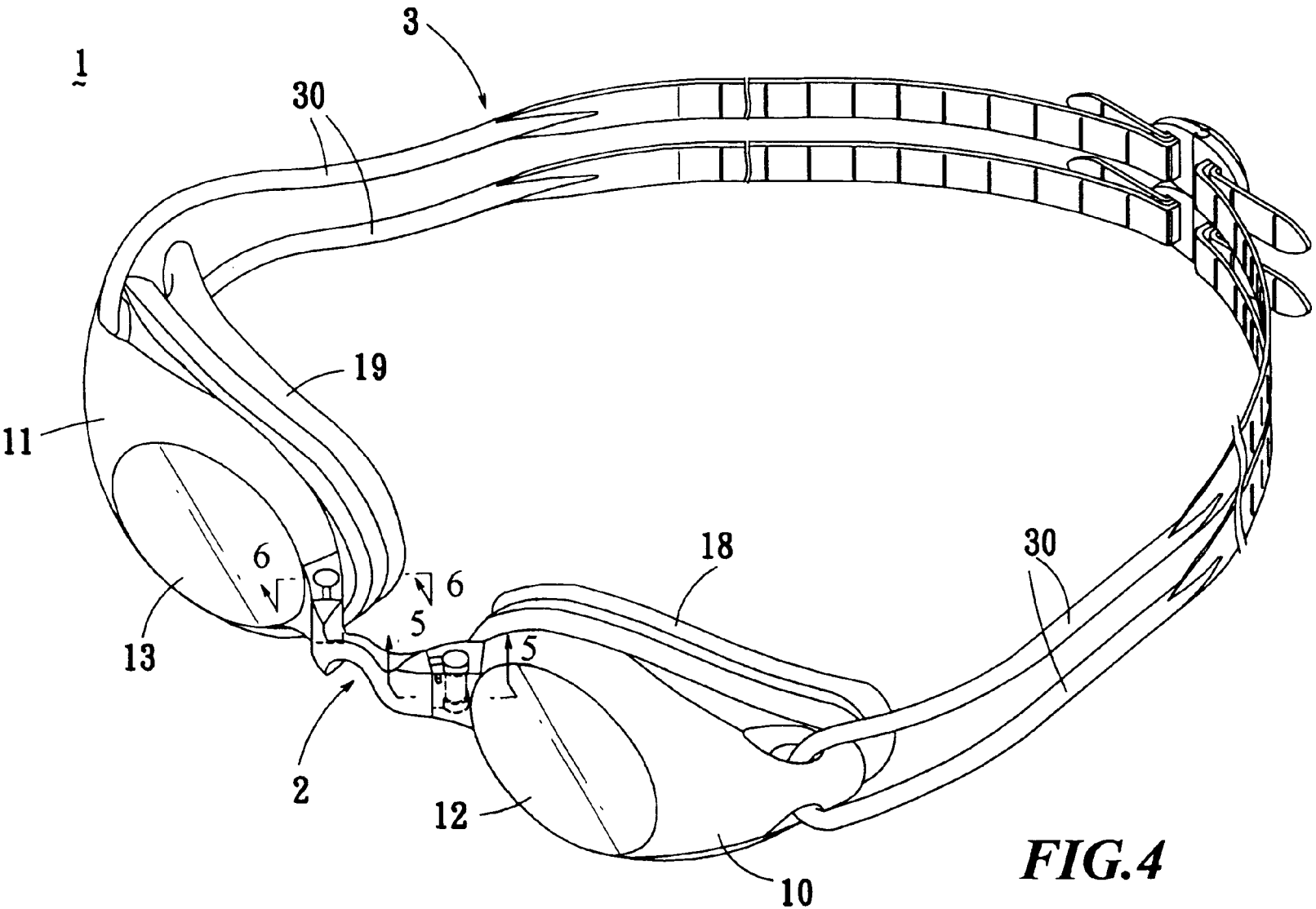

Firstly, referring to FIGS. 3 and 4, the first preferred embodiment of a swimming goggles 1 according to the present invention is shown to comprise two lens frames 10,11, a nose bridge 2 and a strap means 3, wherein each of lens frame 10,11 has a lens unit 12,13 formed integrally, and joining holes 14,15 which are respectively formed on the outside of the major axis of the lens frame 10,11 for offering a strap element 30 of the strap means 3 passing through and positioning. A gasket 18,19 is fixed to the lens frames 10,11 and opposite the lens unit 12,13 for providing comfortable contacting with the user's face. In order to understand and describe conveniently, it will take one of two lens frames 10,11 introduced below. Referring to FIG. 2, the lens frame 10 has a chamfer 16 extending from the inner side of a major axis of the lens frame 10 for connection of the nose bridge 2, a hollow 161 with an open end at an inner portion of the chamfer 16, a stopper 163 on an upper portion of the open end and the dimension of the stopper 163 is larger than the dimension of the hollow 161, and a pit 162 is disposed transversely and at an end of the hollow 161.

Figure 5:
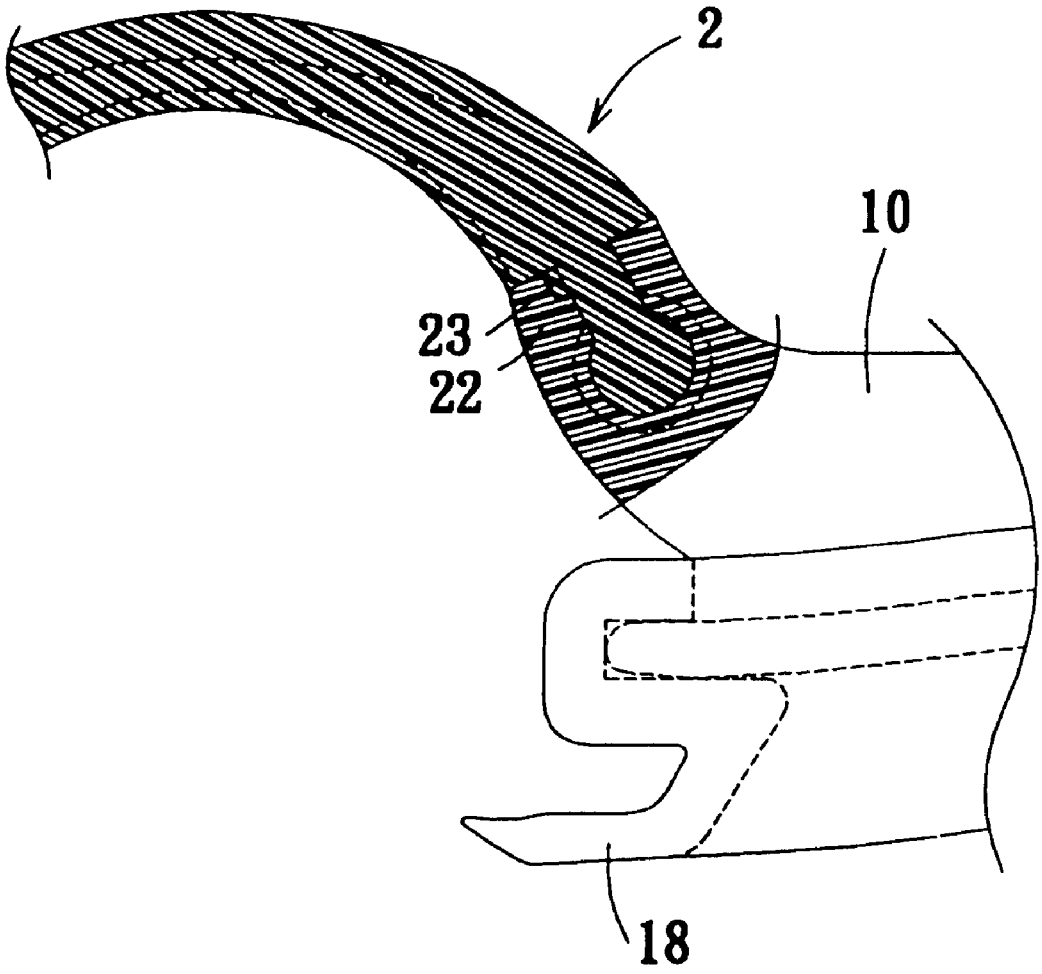
FIGS. 5 and 6 are sectional views of the present invention taken along line 5—5 and 6—6 in FIG. 4.
Figure 6:
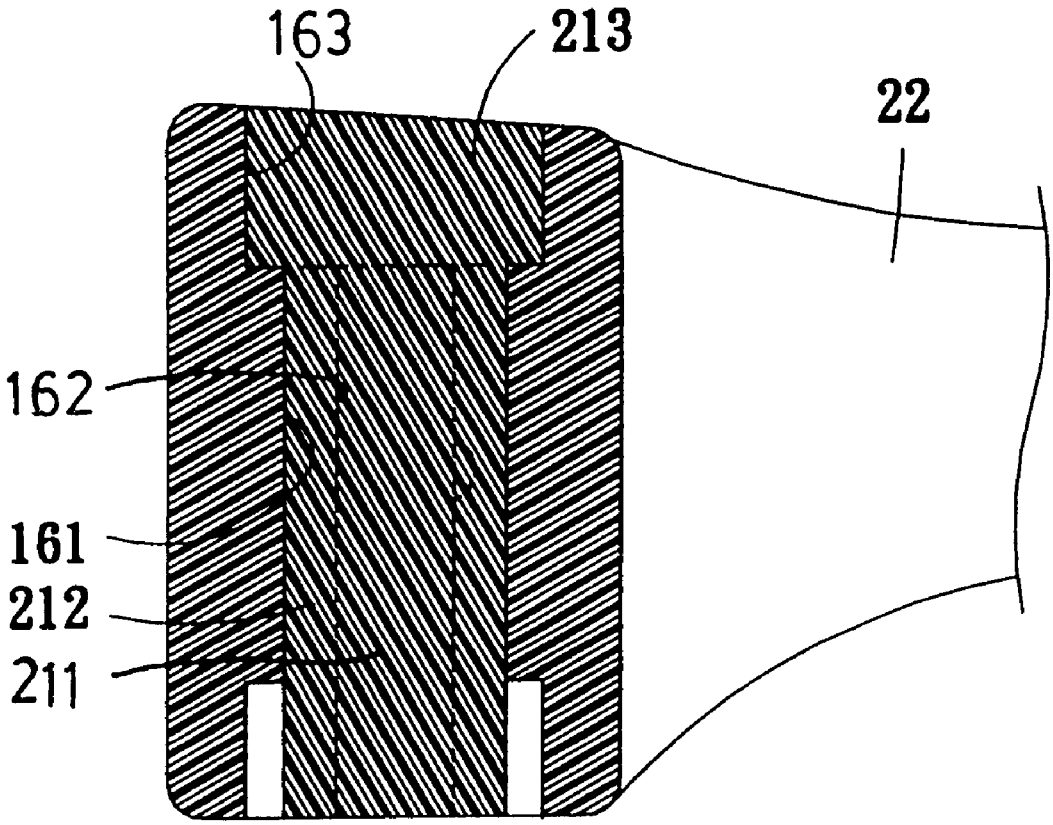

The nose bridge 2 is mounted between two lens frames 10,11 and has a body 20 with a staff 21 on each end for engaging the hollow 161 and the pit 162. The staff 21 has a neck portion 211 which is formed on the edge of the body 20, and a roundness body 212 extending from the neck portion 211. An enlarged end 213 on an upper portion of the rounded body 212 is capable of coupling with the stopper 163. Further referring to FIG. 6, the neck portion 211 and the roundness body 212 will be able to engage to the pit 162, and the enlarged end 213 will be able to engage to the stopper 163 when the staff 21 of the nose bridge 2 connects to the chamfer 16 of the lens frames 10,11. Referring to FIG. 5, a first positioning unit and second positioning unit mounted between the staff 21 and the chamfer 16 can mutually engage together, wherein the first position unit is a jutting 22 formed on the staff 21, and the second position unit is a groove 23 located with respect to to the chamfer 16 so that it can be engaged to the jutting 22, so as to enable better securing effect between the staff 21 and chamfer 16.

Referring once more to FIGS. 2 and 3, the strap means 3 comprising a strap element 30 with a first and a second free end and a fastener 31 having a first jacket assembly 32 and a second jacket assembly 33 mounted respectively on the first and second free end of the strap element 30 and can be a mutual connection forming one unit, each of the first jacket assembly 32 and second jacket assembly 33 has a pass through portion 34 for providing each strap element 30 passing through, the pass through portion 34 has a socket 341 and a pole 342 which is mounted within the socket 341 to separate the socket 341 into two passing spaces. A first receiving portion 35 is an elongated slot which can be disposed on the edge of the first jacket assembly 32. A second receiving portion 36 is a bar which can be disposed on the edge of the second jacket assembly 33 whereby the bar is co-operable with the elongated slot, such that the first jacket assembly 32 and second jacket assembly 33 can easily match each other when in assembly.

Referring to FIG. 3, during assembly, the staff 21 of the nose bridge 2 engages the chamfer 16 of each lens frame 10,11 so as to easily and conveniently assemble the nose bridge 2 and the lens frame 10,11 into one unit. Moreover, referring to FIGS. 5 and 6, the enlarged end 213 engages the pit 162 so that the staff 21 keeps a certain position, and the jutting 22 engages the groove 23 providing the nose bridge 2 and the lens frame 10,11 securely in position, such that the user can conveniently assemble and replace the nose bridge 2 to match user's nose.

Figure 7:
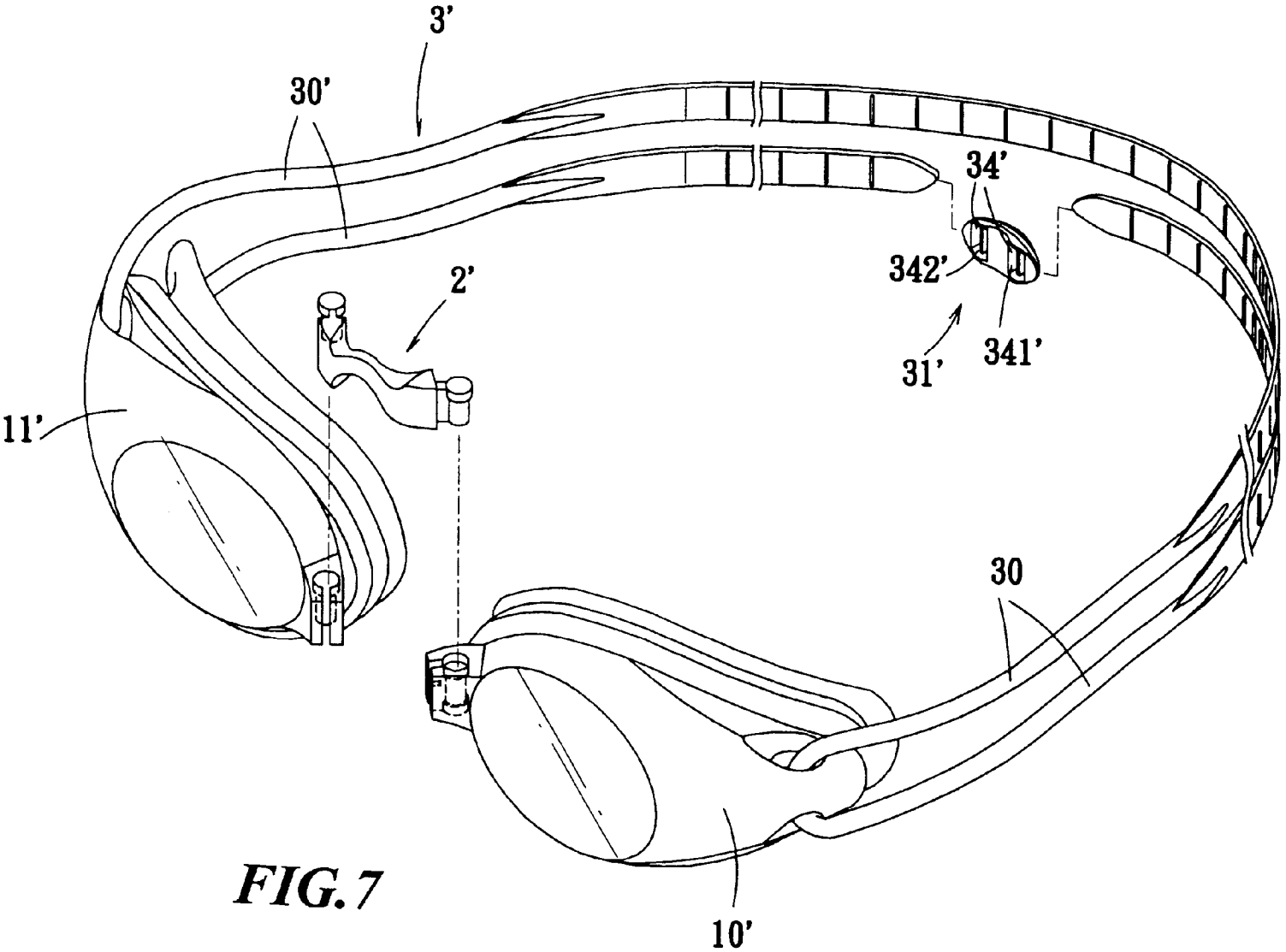
FIGS. 7 and 8 are perspective views which illustrates disassembly and assembly of the second preferred embodiment of the present invention.
Figure 8:
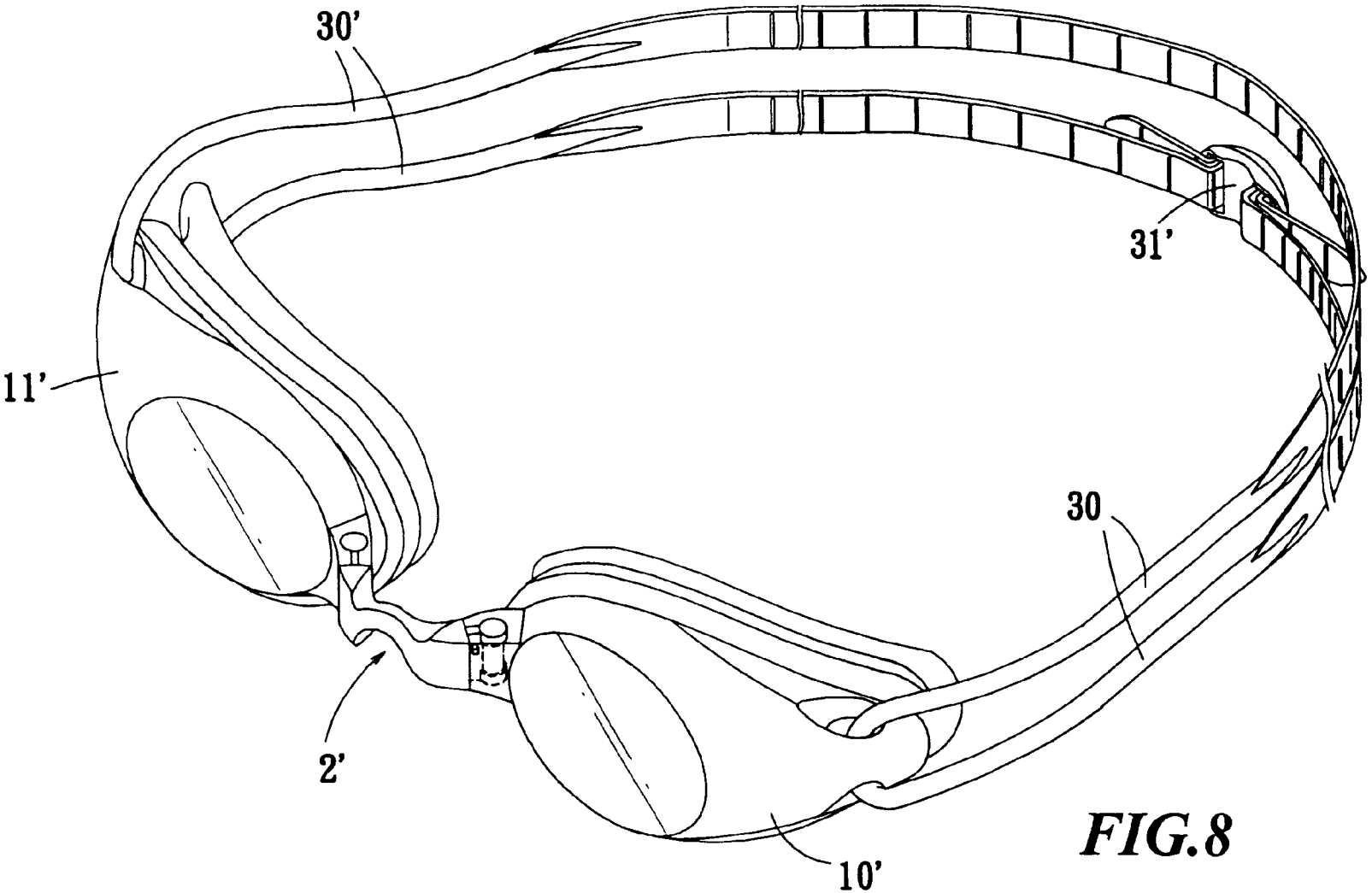

FIGS. 7 and 8 illustrate the second preferred embodiment of a pair of swimming goggles according to the present invention, the second embodiment is generally similar to the first embodiment, comprising two lens frames 10', 11', a nose bridge 2' and a strap mean 3', the main difference residing in the constructions of the fastener 31' of the strap means 3' being formed integrally, the fastener 31' having two pass through areas 34', each of which has a socket 341' and a pole 342' which is mounted within the socket 341' and separates the socket 341' into two passing spaces, two strap elements 30' having a first free end and a second free end respectively passing through each lens frame 10', 11' and the fastener 31' for connection of two lens frames 10', 11' together.

Figure 9:
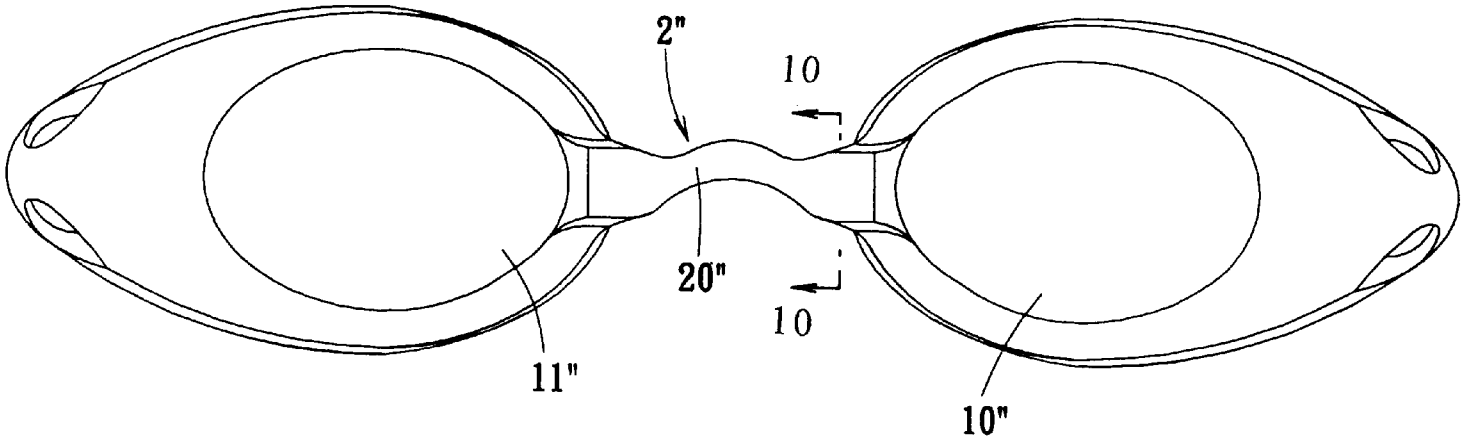
FIG. 9 is a front view of the third preferred embodiment of the present invention.
Figure 10:
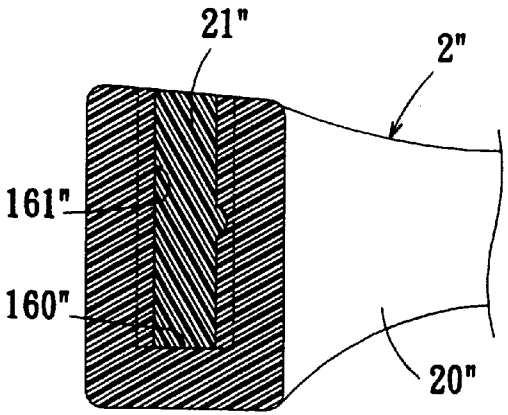
FIG. 10 is a sectional view of the present invention taken along line 10—10 in FIG. 9.

FIGS. 9 and 10 illustrate the third preferred embodiment of a pair of swimming goggles according to the present invention, the third embodiment is generally similar to the first embodiment, the main difference residing in the assembly style of the staff 21" of the nose bridge 2" and the length of mouth 161" of each lens frame 10", 11", the staff 21" has deleted the stopper, the hollow 161" has an open end and a closed end 160" on the bottom of the hollow 161", such that the nose bridge 2" and two lens frames 10", 11" also can be securely assembled.

While the present invention has been described in connection with what is considered the most practical and preferred embodiment, it is understood that this invention is not limited to the disclosed embodiments but is intended to cover various arrangements, included within the spirit and scope of the broadest interpretation so as to encompass all such modifications and equivalent arrangements.

What is claimed is:

1. A pair of swimming goggles, comprising:

two lens frames, each of having a lens unit thereon, and a chamfer extending from the inner side of a major axis thereof, a hollow with an open end at an inner portion of the chamfer, wherein a pit is disposed transversely and at an end of the hollow, a nose bridge for joining the two lens frames including a body with a staff on each end thereof, the staff has a neck portion formed on the edge of the body and a rounded body extending therefrom, and a strap means comprising a strap element with a first and a second free end and a fastener having a first jacket assembly and a second jacket assembly mounted respectively on the first and second free end of the strap element whereby the first and second jacket assembly are connectable, wherein each of the first and second jacket assembly including:

a pass through portion for receiving the strap element having a socket and a pole mounted within the socket to separate the socket into two passing spaces;

a first receiving portion being an elongated slot disposed on the end the first jacket assembly, the elongated slot being open at a first and a second end; and a second receiving portion being a bar disposed on the end of the second jacket assembly whereby the bar is co-operable with the elongated slot such that the first and second jacket assembly are connectable.

2. The swimming goggles as claimed in claim 1, wherein the hollow further comprises a closed end opposite with the open end.

3. A pair of swimming goggles, comprising:

two lens frames, each of having a lens unit thereon, and a chamfer extending from the inner side of a major axis thereof, a hollow with an open end at an inner of the chamfer, a stopper on an upper portion of the open end and the dimension of the stopper is larger than the dimension of the hollow, wherein a pit is disposed transversely and at an end of the hollow, a nose bridge for joining the two lens frames including a body with a staff on each end thereof, the staff has a neck portion formed on the edge of the body and a rounded body extending therefrom, an enlarged end on an upper portion of the rounded body which is capable of coupling with the stopper, and a strap means comprising a strap element with a first and a second free end and a fastener having a first jacket assembly and a second jacket assembly mounted respectively on the first and second free end of the strap element whereby the first and second jacket assembly are connectable, wherein each of the first and second jacket assembly including:

a pass through portion for receiving the strap element having a socket and a pole mounted within the socket to separate the socket into two passing spaces;

a first receiving portion being an elongated slot disposed on the end the first jacket assembly, the elongated slot being open at a first and a second end; and a second receiving portion being a bar disposed on the end of the second jacket assembly whereby the bar is co-operable with the elongated slot such that the first and second jacket assembly are connectable.

4. A nose bridge for connecting a first lens frame and a second lens frame comprising a body with a staff on each end for engaging a chamfer of the lens frames, the staff has a neck portion formed on the edge of the body and a rounded body extending therefrom, a stopper on an end of the staff being an enlarged end of the rounded body.

* * * * *